US008068726B2

(12) United States Patent
Saunders et al.

(10) Patent No.: US 8,068,726 B2
(45) Date of Patent: Nov. 29, 2011

(54) PORTABLE COLLAPSIBLE RADIANT HEATER

(75) Inventors: Craig M. Saunders, Rocky River, OH (US); Lindsey Tufts, Jr., Eastlake, OH (US)

(73) Assignee: J. F. Meskill Enterprises, LLC, Cleveland, OH (US)

( * ) Notice: Subject to any disclaimer, the term of this patent is extended or adjusted under 35 U.S.C. 154(b) by 938 days.

(21) Appl. No.: 11/961,152

(22) Filed: Dec. 20, 2007

(65) Prior Publication Data

US 2008/0152329 A1 Jun. 26, 2008

Related U.S. Application Data

(60) Provisional application No. 60/876,939, filed on Dec. 22, 2006.

(51) Int. Cl.
*A45D 20/40* (2006.01)
*F21V 7/00* (2006.01)

(52) U.S. Cl. ..... 392/407; 392/422

(58) Field of Classification Search ..... 392/407, 392/408–440, 422
See application file for complete search history.

(56) References Cited

U.S. PATENT DOCUMENTS

| | | | | |
|---|---|---|---|---|
| 4,159,411 | A | 6/1979 | Ellersick | |
| D325,963 | S | 5/1992 | Anderson | |
| 5,964,233 | A | 10/1999 | Clark et al. | |
| D429,324 | S | 8/2000 | Olson et al. | |
| 6,102,031 | A | 8/2000 | Waters | |
| D474,532 | S | 5/2003 | Chan et al. | |
| 6,650,830 | B2 | 11/2003 | Kerec | |
| 2005/0175950 | A1 * | 8/2005 | Waters | 432/209 |

FOREIGN PATENT DOCUMENTS

WO WO 02/073092 A1 9/2002

* cited by examiner

*Primary Examiner* — Daniel Robinson
(74) *Attorney, Agent, or Firm* — Fay Sharpe LLP

(57) ABSTRACT

A portable, collapsible radiant heater includes a base and a support mounted to the base. The support has a collapsed position wherein the base is configured to at least partially receive the support, and an extended position wherein the support extends upwardly from the base. A heater-head for generating radiant heat is connected to the support. A reflector is mounted to one of the heater-head and the support. The reflector at least partially surrounds the heater-head for downwardly reflecting radiant heat generated by the heater-head. The reflector and heater-head are reciprocally movable between the collapsed position wherein the reflector and heater-head are in close proximity to the base and the extended position wherein the reflector and heater-head are distant from the base.

20 Claims, 14 Drawing Sheets

FIG. 21
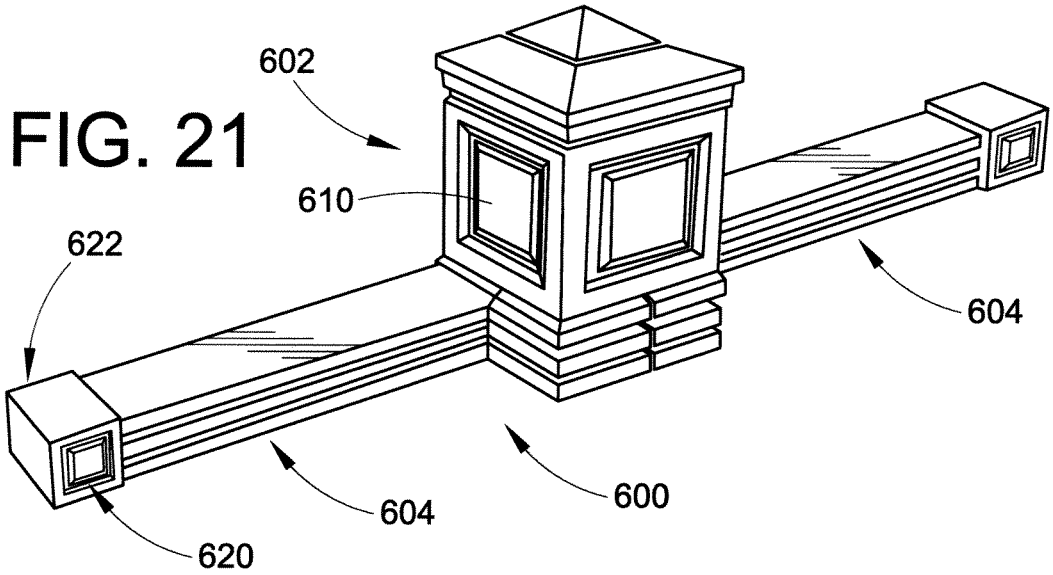
FIG. 22
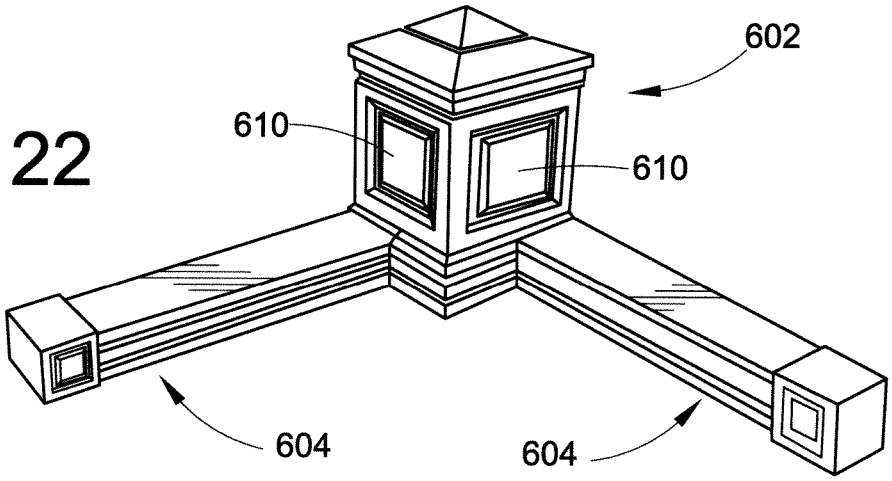
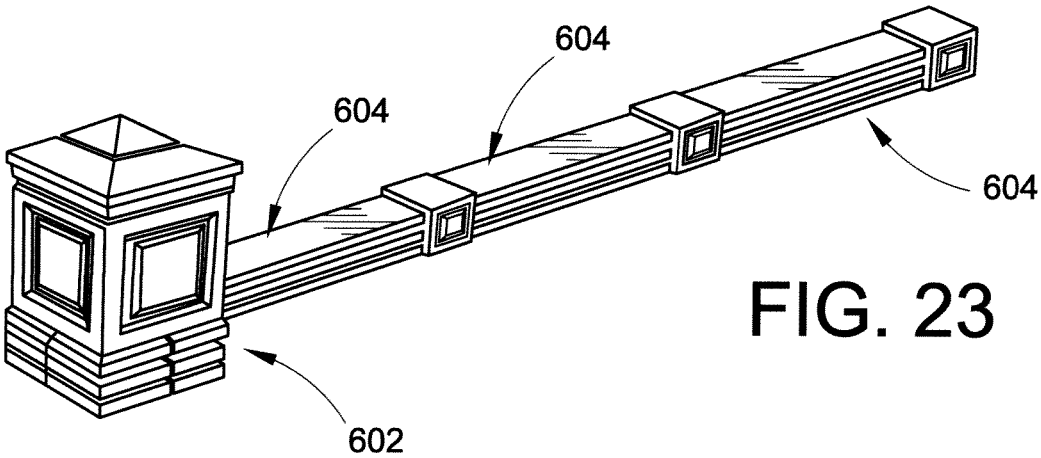
FIG. 23

PORTABLE COLLAPSIBLE RADIANT HEATER

CROSS REFERENCE TO RELATED APPLICATIONS

This application claims priority from U.S. Provisional Patent Application Ser. No. 60/876,939 filed Dec. 22, 2006, which is expressly incorporated herein by reference, in its entirety.

BACKGROUND

The present disclosure relates to a heater. More specifically, the present disclosure is concerned with a collapsible portable heater for warming a preselected area.

Radiant heaters are well known and used to provide heat to selected areas of a given space. These heaters may be used to heat spaces such as workshops, patios, terraces and the like. One type of radiant heaters, LP/propane or natural gas fueled heaters are available in both free-standing and built-in configurations, and are primarily sold for commercial applications. For example, patio heaters have become especially popular in recent years in areas where no smoking laws are being applied to taverns and bars forcing patrons outdoors to smoke which can be especially inconvenient during cold nights. Patio heaters can be utilized to provide warmth in preselected outdoor areas making it much more comfortable for smokers, and for those who like to be outdoors.

Free-standing patio heaters that can be readily moved from location to location to heat preselected areas typically have a base that is sized to contain a fuel tank therein and an elongate hollow support projecting upward therefrom to a burner assembly housing in which air is heated by combustion of the fuel gases from the tank in the base. The burner assembly housing generally has a cylindrical wall provided with apertures to provide for the escape of the hot products of combustion in the housing. The flow of hot gases through the wall apertures heats the wall so that the wall emits radiant infra-red heat. A relatively large dome-shaped reflector is attached on top of the housing and opens downwardly for reflecting heat emanating from the housing generally downwardly about the support of the patio heater.

In the built-in configuration, which typically will not be moved after the unit is installed, the heater is connected to a source of gas such as provided by a gas utility company. This eliminates the need for the base so that the support extends all the way from the ground up to the burner assembly housing. In each of the free-standing and built-in configurations, the burner assembly housing and reflector dome have substantially the same construction. Other heaters may be mounted to the ceiling, still others may be fixedly mounted to a wall surface.

A drawback of the prior art heaters is that they often direct heat to a limited area. Another drawback is that the prior art heaters are oftentimes cumbersome to move and difficult to store when not in use. Accordingly, the present disclosure provides a new and improved portable, collapsible radiant heater which overcomes certain difficulties with the prior art designs.

BRIEF DESCRIPTION

In accordance with one aspect of the present disclosure, a portable, collapsible radiant heater comprises a base and a support mounted to the base. The support has a collapsed position wherein the base is configured to at least partially receive the support, and an extended position wherein the support extends upwardly from the base. A heater-head for generating radiant heat is connected to the support. A reflector is mounted to one of the heater-head and the support. The reflector at least partially surrounds the heater-head for downwardly reflecting radiant heat generated by the heater-head. The reflector and heater-head are reciprocally movable between the collapsed position wherein the reflector and heater-head are in close proximity to the base and the extended position wherein the reflector and heater-head are distant from the base.

In accordance with another aspect of the present disclosure, a portable, collapsible radiant heater comprises a base including a top surface and a collapsible support mounted to the base. A burner assembly for igniting fuel from a fuel source is housed in the base. The burner assembly is pivotally connected to the support. A reflector is mounted to one of the burner assembly and the support. The reflector at least partially surrounds the burner assembly for downwardly reflecting radiant heat generated by the burner assembly. In a collapsed position, an outer periphery of the reflector at least partially covers the top surface of the base thereby providing for a compact, easily storable radiant heater.

In accordance with yet another aspect of the present disclosure, a portable, collapsible radiant heater comprises a base including a top surface and a telescopic support mounted to the base. A heater-head for generating radiant heat is connected to the support. A reflector is mounted to one of the heater-head and the support. The reflector at least partially surrounds the heater-head for downwardly reflecting the radiant heat. The reflector and heater-head are telescopically movable between a collapsed position wherein the reflector and heater-head are in close proximity to the base and an extended position wherein the reflector and heater-head are distant from the base.

Still other aspects of the present disclosure will become apparent from a reading and understanding of the detailed description of the several embodiments described hereinbelow.

BRIEF DESCRIPTION OF THE DRAWINGS

The present disclosure may take physical form in certain parts and arrangements of parts, several embodiments of which will be described in detail in this specification and illustrated in the accompanying drawings which form a part of the disclosure.

FIG. 21 is a front perspective view of a portable, collapsible radiant heater in a first position according to a sixth embodiment of the present disclosure.

FIG. 22 is a front perspective view of the radiant heater of FIG. 21 in a second position.

FIG. 23 is a front perspective view of the radiant heater of FIG. 21 in a third position.

DETAILED DESCRIPTION

Figure 1:
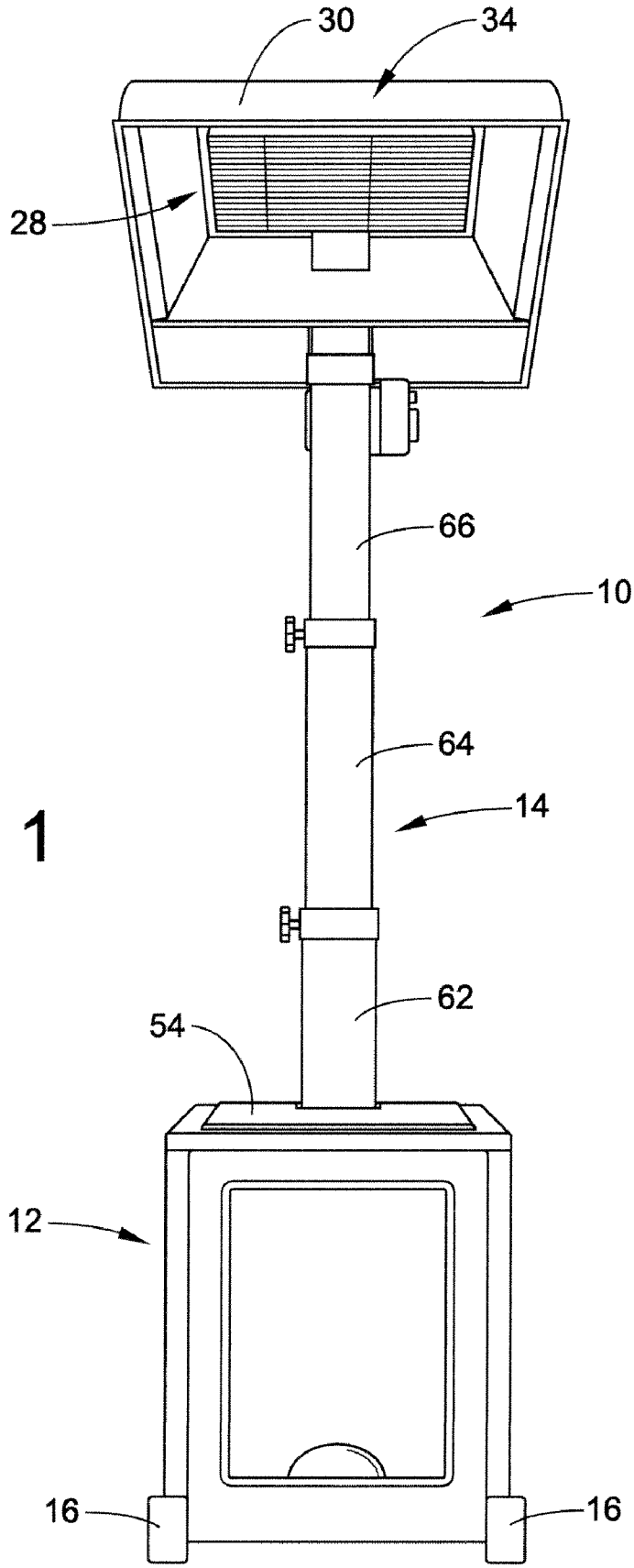
FIG. 1 is a front perspective view of a portable, collapsible radiant heater in a first extended position according to a first embodiment of the present disclosure.

It should, of course, be understood that the description and drawings herein are merely illustrative and that various modifications and changes can be made in the structures disclosed without departing from the scope and spirit of the disclosure. It will also be appreciated that the various identified components of the portable collapsible heater disclosed herein are merely terms of art that may vary from one manufacturer to another and should not be deemed to limit the present disclosure. All references to direction and position, unless otherwise indicated, refer to the orientation of the heater illustrated in the drawings.

Referring now to the drawings, wherein like numerals refer to like parts throughout the several views, FIG. 1 illustrates a portable, collapsible heater 10 in a first fully extended position according to a first embodiment of the present disclosure. The heater 10 can be adapted to utilize compressed or liquefied gas fuel to generate heated air by the hot gases of combustion and radiant infrared heat for keeping an area about the heater heated. The heater 10 is often termed a "patio heater" as it is designed primarily for outdoor use such as during nighttime in patio areas outside of taverns and bars so that patrons can spend time outdoors in a comfortable preselected area which is warmer than the colder outdoor temperature.

Figure 2:
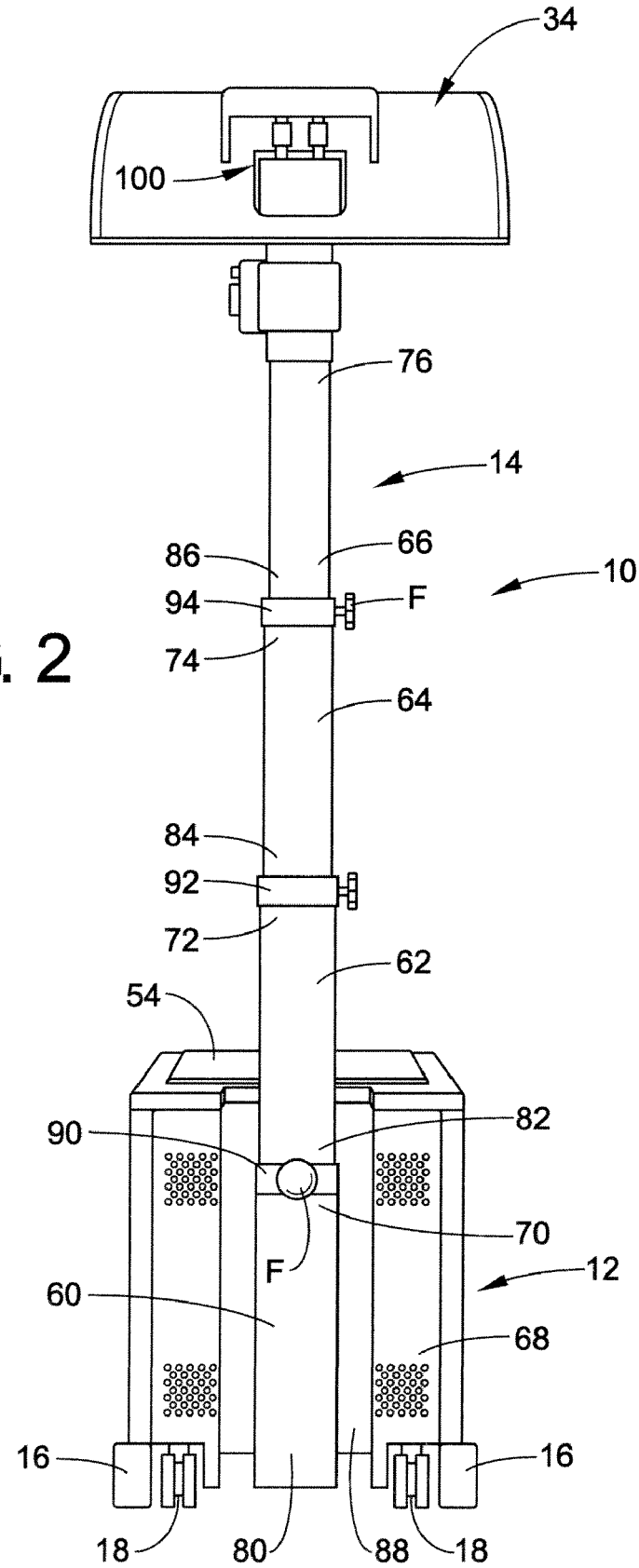
FIG. 2 is a rear perspective view of the radiant heater of FIG. 1.
Figure 3:
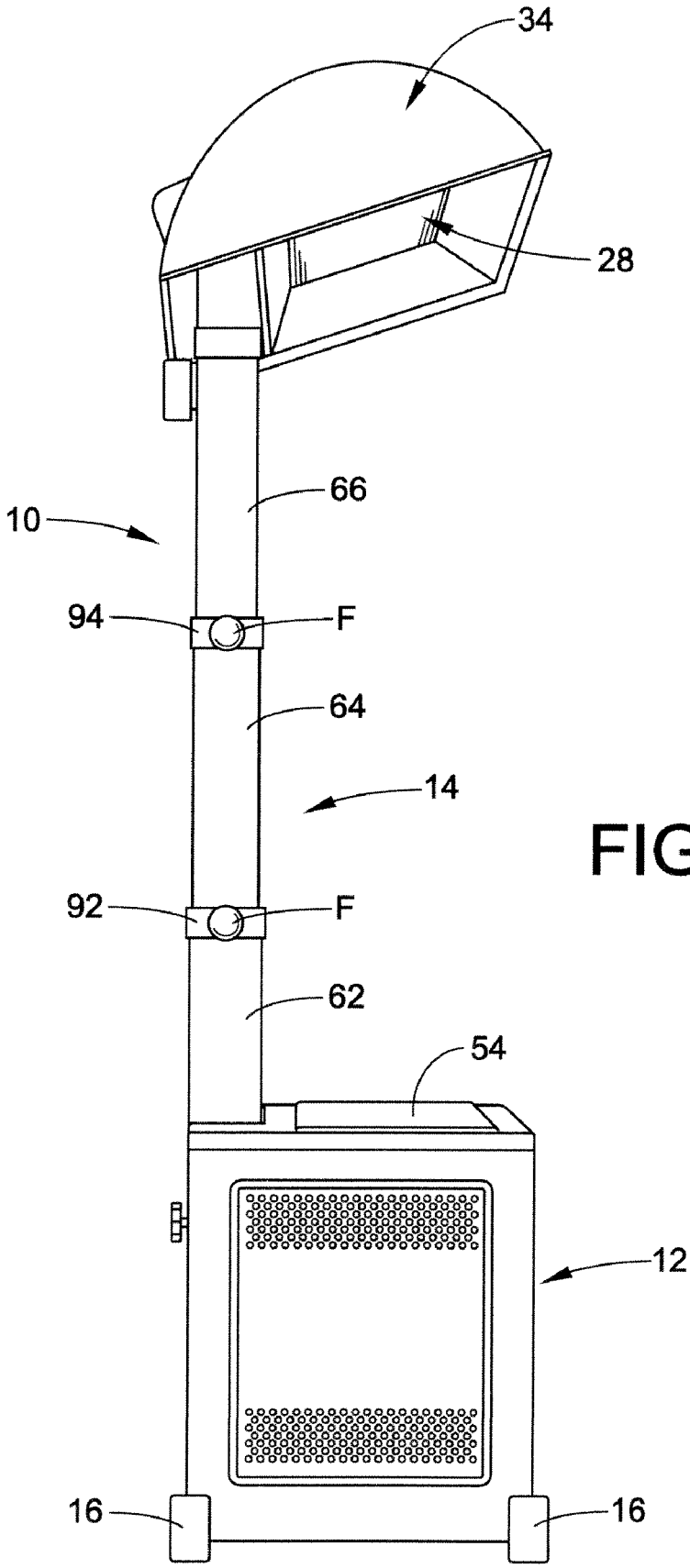
FIG. 3 is a side perspective view of the radiant heater of FIG. 1.

As shown in FIGS. 1-3, the radiant heater 10 generally comprises a base 12 at the bottom of and connected to an elongate support member 14. As will be discussed in greater detail below, the support has a collapsed position wherein the base is configured to at least partially receive the support, and an extended position wherein the support extends upwardly from the base. Mounted to a lower portion of the base are a plurality of spaced apart feet 16, which are generally flush with a support surface to eliminate tipping of the heater. At least two of the feet can include pads, which can be made of rubber, to prevent the base from slipping. Casters or wheels 18 can be mounted to a lower surface (not visible) of the base near the support 14 for ease of moving the heater from location to location. The base can have an interior space 20 for containing a source of compressed or liquefied gas fuel therein, such as a LP tank 22, as shown in FIGS. 6-9.

The support 14 preferably is hollow so that a gas line 24 can be run therethrough from the source of fuel up to a heater-head or burner assembly 28 contained in a housing 30 therefor. It should be appreciated that because the support is collapsible, the gas line is of a type that can be easily coiled within the support as it collapses without crimping. It is also contemplated that the heater 10 can be connected to an underground gas line such as provided by a gas utility and the gas line connected to the underground utility line thus eliminating the need for the LP tank 22.

Figure 4:
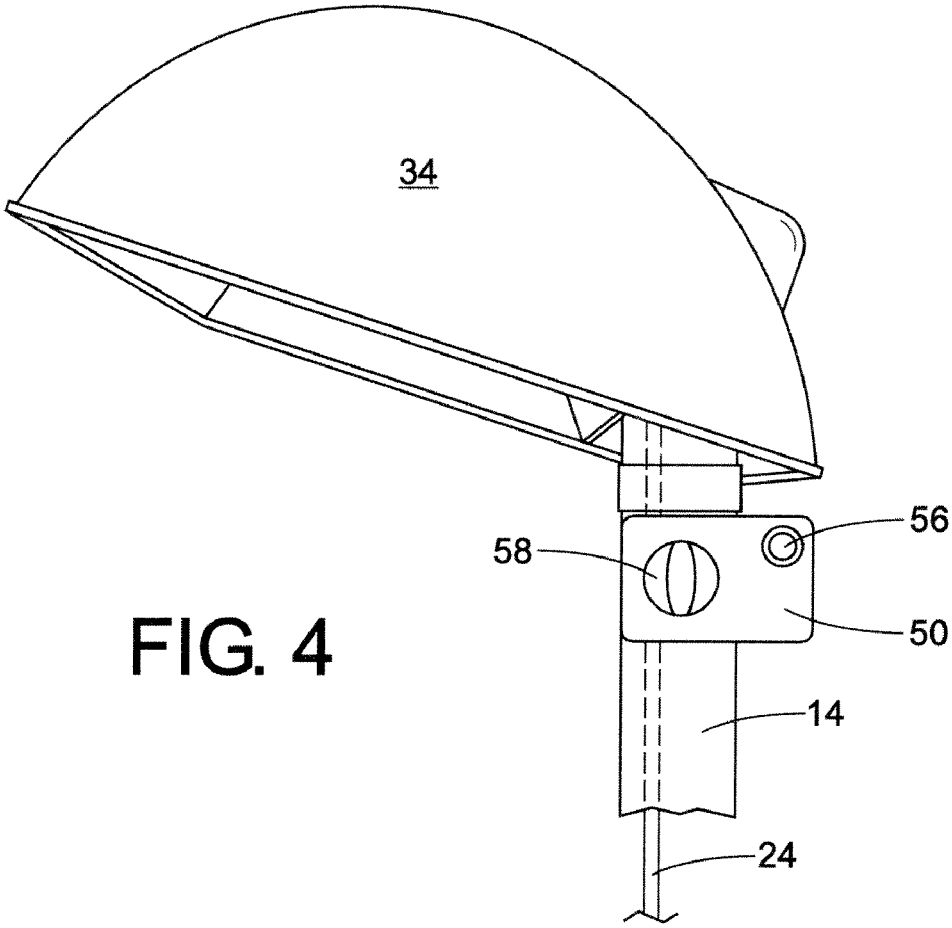
FIG. 4 is an enlarged side perspective view of a burner assembly of the radiant heater of FIG. 1.
Figure 5:
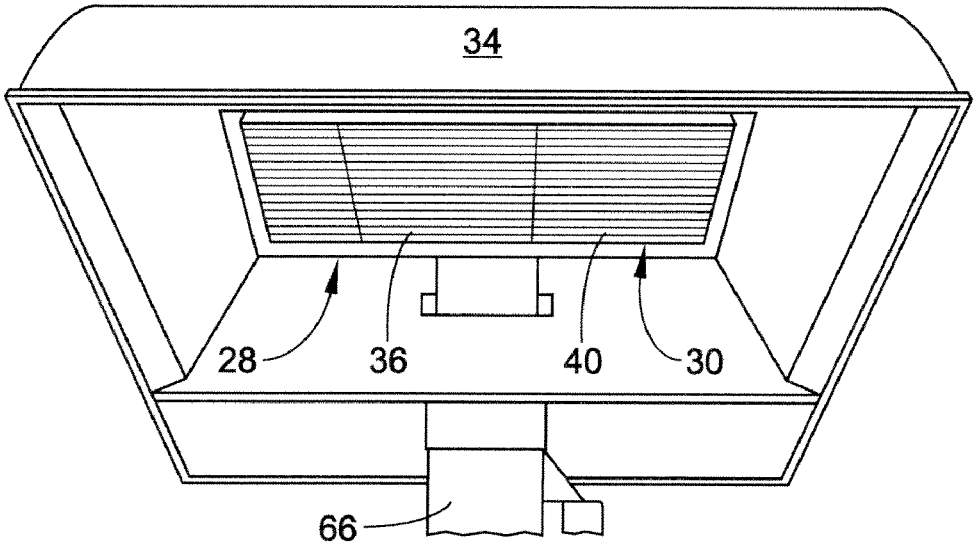
FIG. 5 is an enlarged front perspective view of the burner assembly of FIG. 4.
Figure 6:
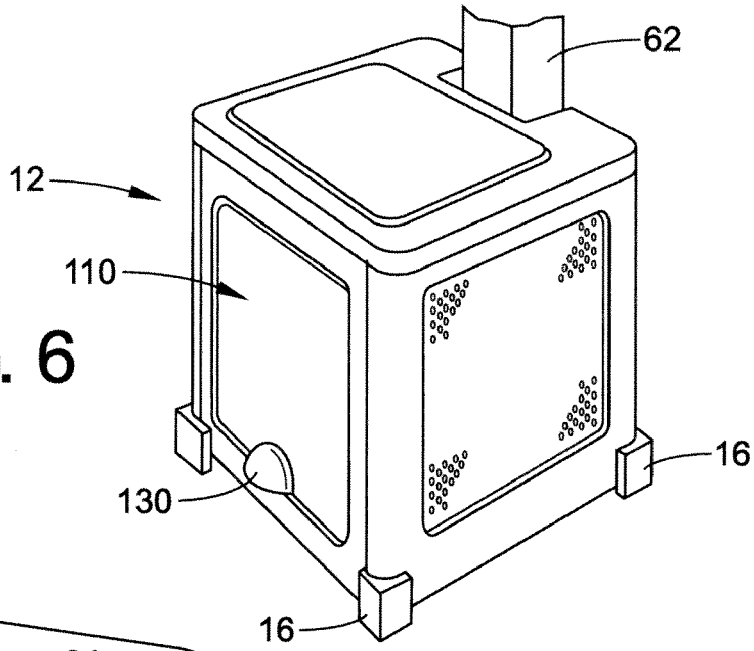
FIG. 6 is an enlarged side perspective view of a base of the radiant heater of FIG. 1 showing a drawer of the base in a closed position.
Figure 9:
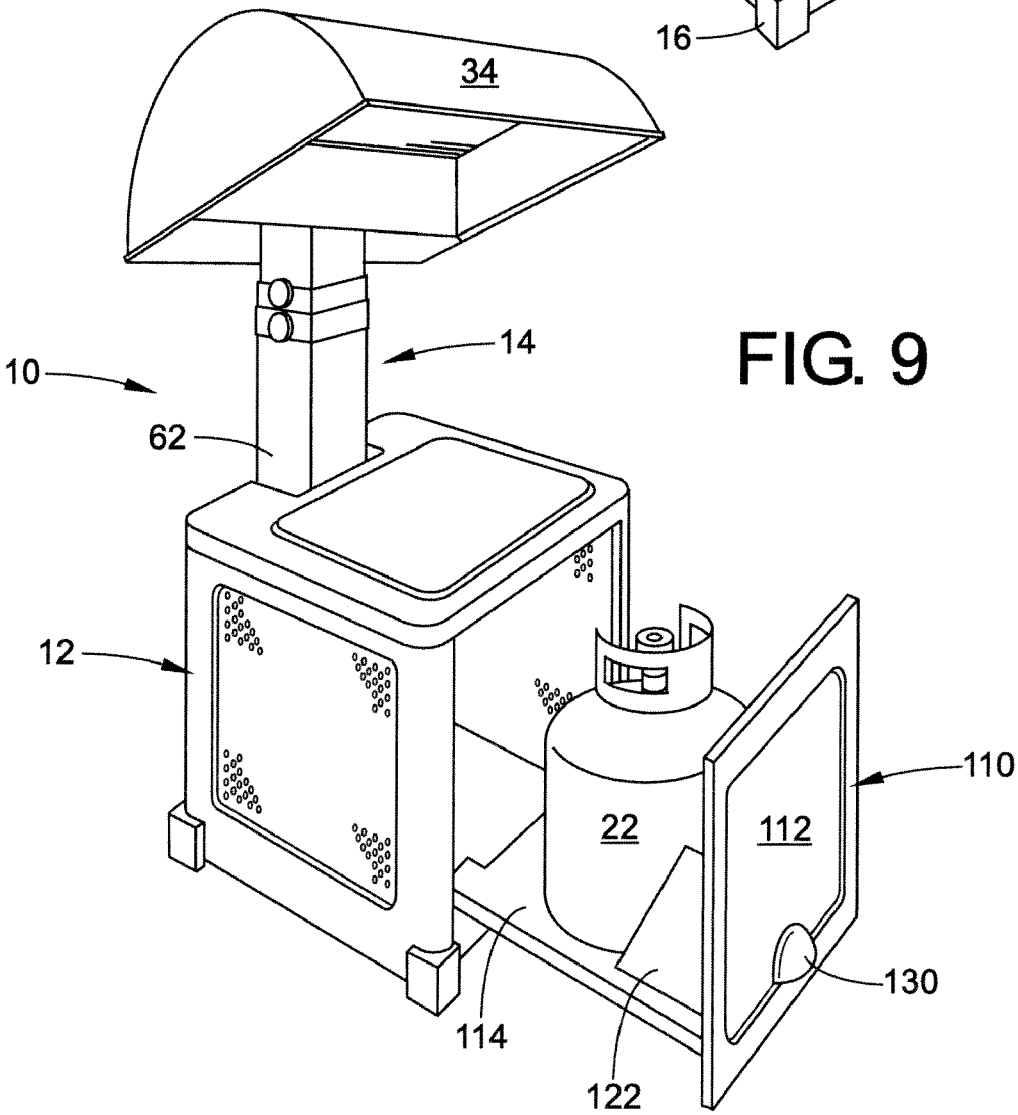
FIG. 9 is a side perspective view of the radiant heater of FIG. 1 in a third extended position.
Figure 8:
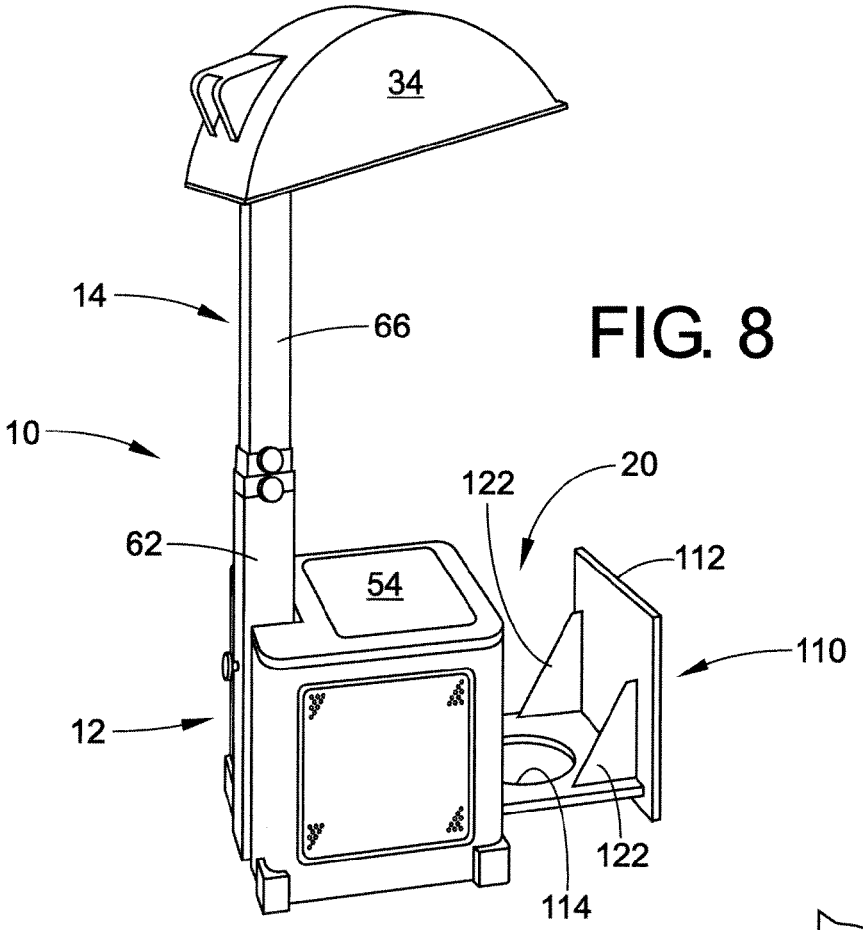
FIG. 8 is a side perspective view of the radiant heater of FIG. 1 in a second extended position.
Figure 7:
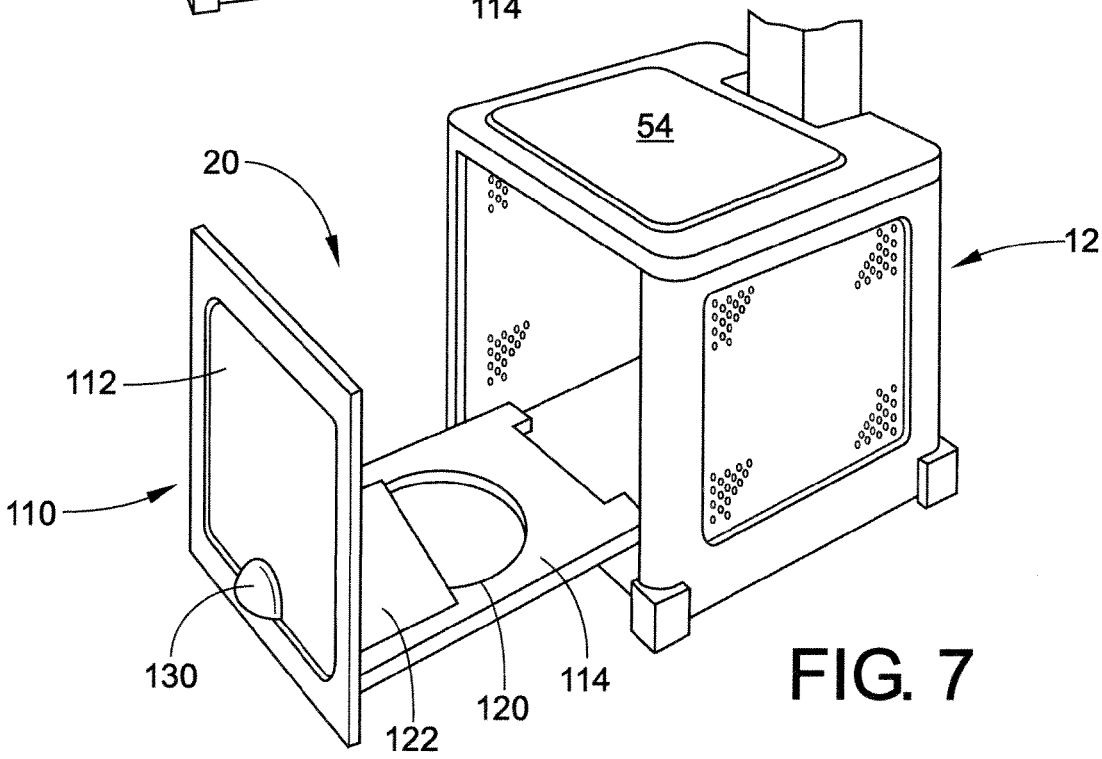
FIG. 7 is a side perspective view of the base of FIG. 6 showing the drawer of the base in a closed position.
Figure 10:
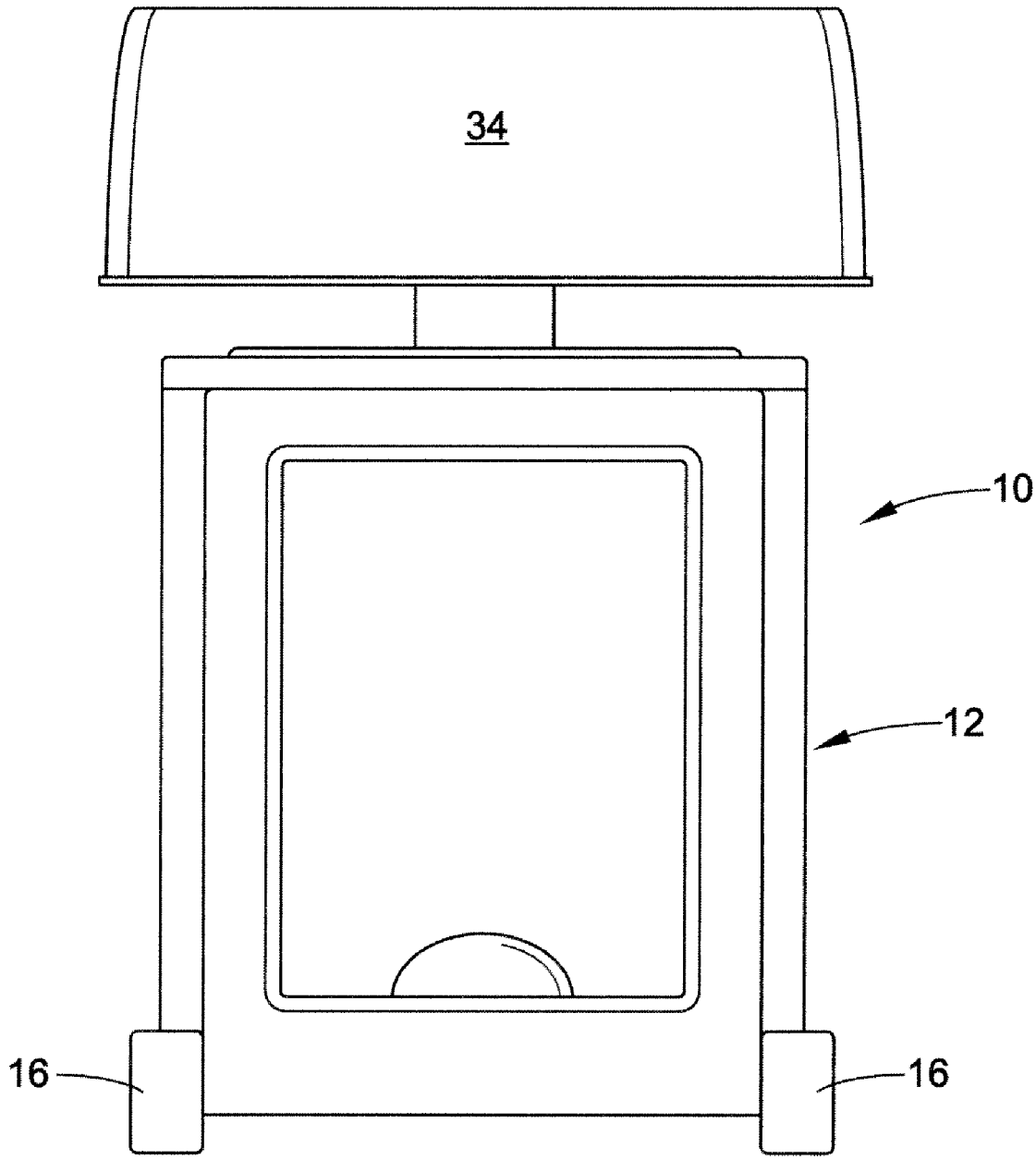
FIG. 10 is a front perspective view of the radiant heater of FIG. 1 in a collapsed position.
Figure 11:
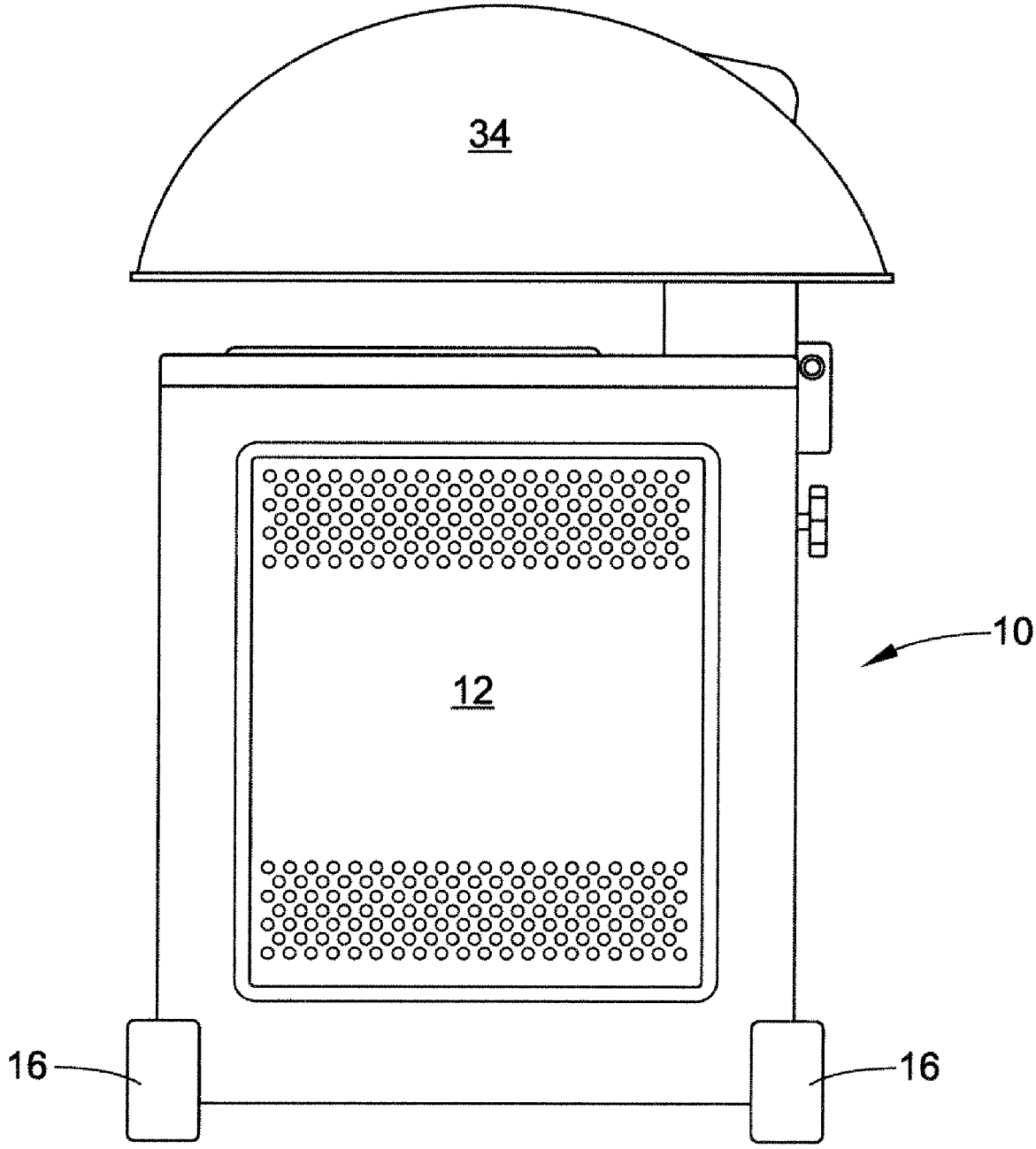
FIG. 11 is a side perspective view of the radiant heater of FIG. 10.
Figure 12:
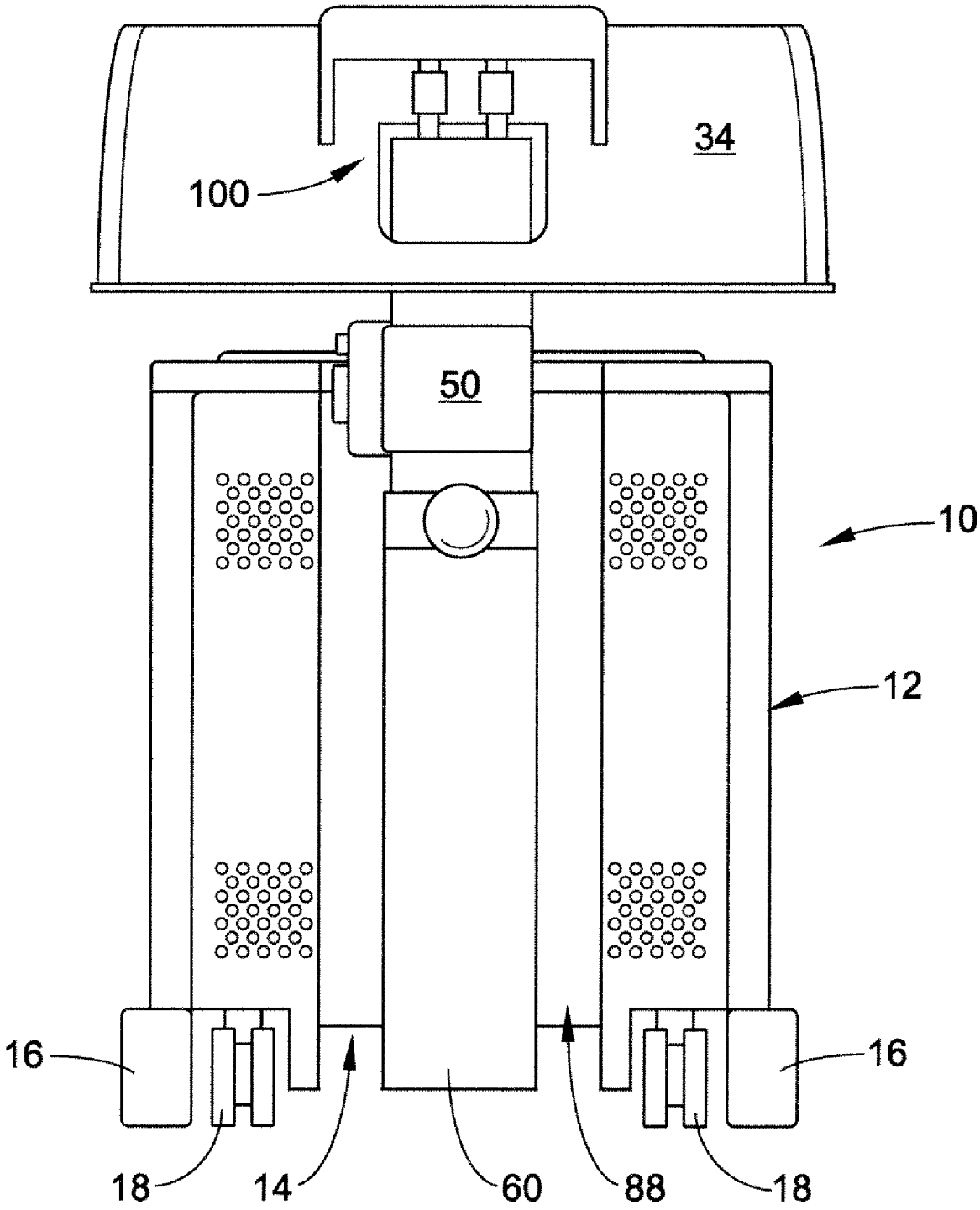
FIG. 12 is a rear perspective view of the radiant heater of FIG. 10.

With reference to FIGS. 4 and 5, a reflector 34 at least partially surrounds the burner assembly. The reflector can be formed integrally with or otherwise attached over a housing 30 of the burner assembly 28. The reflector serves to reflect stray radiant heat that rises above the burner assembly housing 30 back down around the support 14 and base 12 of the heater 10. The reflector also serves to protect the housing and burner assembly from exposure to the outdoor environment such as rain, snow, etc. The reflector generally has an outer peripheral or parameter which is approximately the same size as an outer peripheral or parameter of the base, in order to fit within the confines of the base when the heater is in a collapsed position (FIGS. 10-12). Thus, reflector 34 can be significantly smaller in size versus the domes used with prior patio heaters.

The burner assembly housing 30 includes an emitter surface 36 which can be inclined relative to a longitudinal axis of the support 14 so as to face in a generally downward direction; that is, in the direction of an area below the reflector 34 that is desired to be heated. The emitter surface 36 can have apertures 40 formed therein to allow the hot gaseous products of combustion generated by the burner assembly 28 to escape from the housing 30. The emitter surface preferably is of a stainless steel material so that the flow of hot gases through the apertures thereof heats up the emitter surface sufficiently so as to generate radiant infrared heat that emanates therefrom. Although, other materials are also contemplated.

As shown in FIG. 4, a control panel 50 for controlling the burner assembly is provided on the support 14. Alternatively, the control panel can be disposed in a cutout formed on a top surface 54 of the base 12 so that the control panel 50 is recessed therein. The control panel includes an igniter actuator 56 and a gas valve control knob 58 mounted thereon. A burner head (not shown) is fed gas from the source of fuel via the gas line with the gas flow being regulated by the valve control 58. An igniter element (not shown), generally of the piezoelectric type, ignites the gas when the igniter actuator 56 is depressed. A safety shut off is provided, which can be controlled by a thermocouple which is sensitive to temperature variations, to cause an open gas valve (not shown) to close when the flame in the burner head is extinguished for any reason with the gas valve control 58 turned on. In this manner, the flow of gas through the gas line will be shut off when there is no flame present at the igniter element so as to prevent the dangerous accumulation of non-combusted fuel gases in and around the housing 30.

It should be appreciated that instead of the heater-head being a burner assembly for igniting fuel from the fuel source, the heater-head can be an electric heater. In this way, the electric heater-head may be connected to an electric power supply via a wire. The wire can extend through the collapsible support 14 and be connected to a switch assembly mounted to or on the base, similar to the control panel 50.

With reference again to FIGS. 1-3, the support 14 comprises at least two interconnected sections, which can be telescopically received within and secured to each other. In the depicted embodiment, the support includes four interconnected elongated members or sections 60, 62, 64, and 66. Each section includes a respective first end portion 70, 72, 74, 76 and a respective second end portion 80, 82, 84, 86. As shown in FIG. 2, section 60 is attached to a rear wall 68 of the base, the first end portion 70 being spaced from the top surface 54 and the second end portion 80 being spaced from the lower surface of the base. In the illustrated embodiment, section 60 is mounted in an opening or channel 88 located on the rear wall and extending from the lower surface to the upper surface; although, this is not required. Collar 90, 92 and 94 are connected to the respective first end portions 70, 72, 74 of sections 60, 62 and 64. Each collar includes an aperture for receiving a fastener F.

To secure the support in the first fully extended position, shown in FIGS. 1-3, apertures of collars 90, 92, 94 can align with respective apertures located on the second end portions 82, 84, 86 of sections 62, 64, 66. The fastener F engages both apertures to releasably lock the sections together. It should be appreciated that alternate means for releasably locking the sections together are also contemplated. For example, the fasteners can have a generally planar end portions which frictionally engage and retain the sections together. The first end portion 76 of section 66 is operably connected to at least one of the burner assembly 28 and the reflector 34 via a hinge assembly 100. The hinge assembly allows the burner assembly and reflector to pivot thereby directing the heat generated by the burner assembly to be directed to a predetermined area.

The support 14 can be made of a tubular material, such as steel; although, other materials are also contemplated. Each section of the support has a decreasing cross-sectional dimension, section 60 having the largest dimension and section 66 having the smallest dimension. In this regard, and with reference to the partial extended positions of FIGS. 8 and 9 and the collapsed position of FIGS. 10-12, section 66 can be telescopically received within section 64, section 64 can be telescopically received with section 62 and section 62 can be telescopically received within section 60. It should be appreciated that other contours of the support are also contemplated. For example, the support can be made of a cylindrical hollow material, which allows for the sections to be telescopically received within each other. The support 14 allows the reflector 34 and heater-head 28 to be reciprocally movable between the collapsed position wherein the reflector and heater-head is in close proximity to the base 12 and the extended position wherein the reflector and heater-head is distant from the base.

In the collapsed position, the reflector 34 and burner assembly 28 is adjacent the top surface 54. Due to the relatively small size of the reflector and the collapsible support 14, the collapsed heater is particularly well-adapted for storage and retail sale, as it can be compactly packaged for fitting on retail shelf space and into trunks of automobiles after purchase.

With reference to FIGS. 6-9, the base 12 includes drawer 110 slidably received in the interior space 20. The drawer includes a front wall 112 and a tank support 114 extending generally perpendicular from the front wall. The tank support includes an opening 120 dimensioned to snugly fit the tank 22 therein. A reinforcing member or gusset 122 is provided to add further strength and stability to the drawer. Particularly, the reinforcing member extends between the front wall 112 and the tank support 114. This provides additional stability against vertical deflecting forces and maintains the generally perpendicular relationship between the front wall and tank support. A handle 130 can be provided on the front wall to assist a user in sliding the drawer out of the interior space of the base.

Similar to the aforementioned embodiment, additional embodiments of a portable collapsible heater are shown in FIGS. 13-18.

Figure 13:
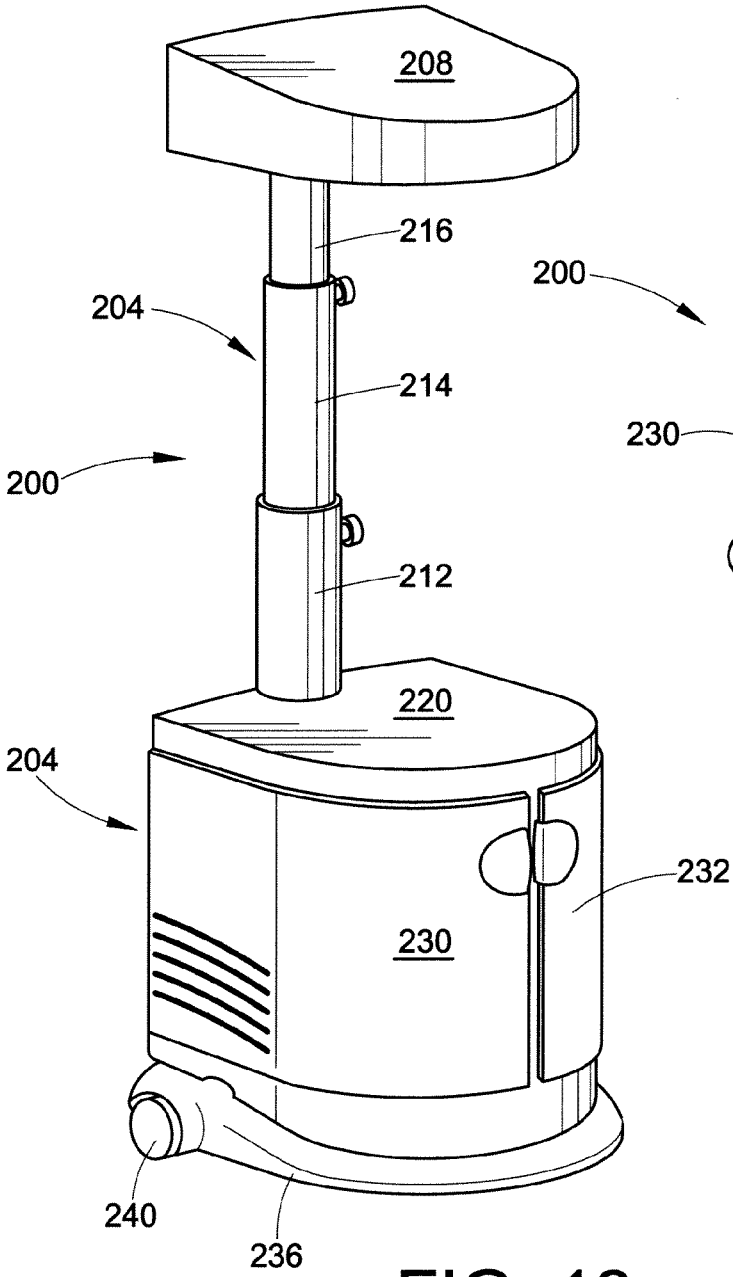
FIG. 13 is a front perspective view of a portable, collapsible radiant heater in an extended position according to a second embodiment of the present disclosure.
Figure 14:
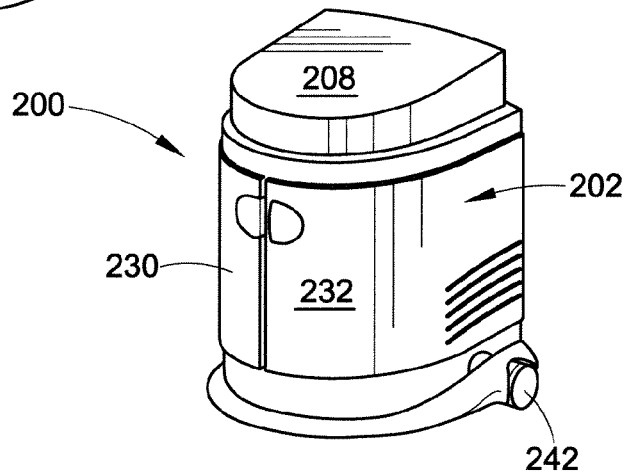
FIG. 14 is a front perspective view of the radiant heater of FIG. 13 in a collapsed position.

In the embodiment of FIGS. 13 and 14, a portable collapsible heater 200 includes a base 202, a collapsible support 204, a heater-head (not shown) and a reflector 208. Similar to the first embodiment, the collapsible support includes a plurality of interconnected sections 212, 214, 216. In the collapsed position, the heater-head is positioned adjacent a top surface 220 of the base and the reflector at least partially covers the top surface. The base can have an interior space (not shown) for containing a source of compressed or liquefied gas fuel therein. A pair of doors 230, 232 is hingedly connected to the base to close the interior. A skirt 236 is attached to a lower portion of the base 202. A portion of the skirt is generally flush with the floor to eliminate tipping of the heater. A pair of wheels 240, 242 is operably connected to the heater base 202.

Figure 15:
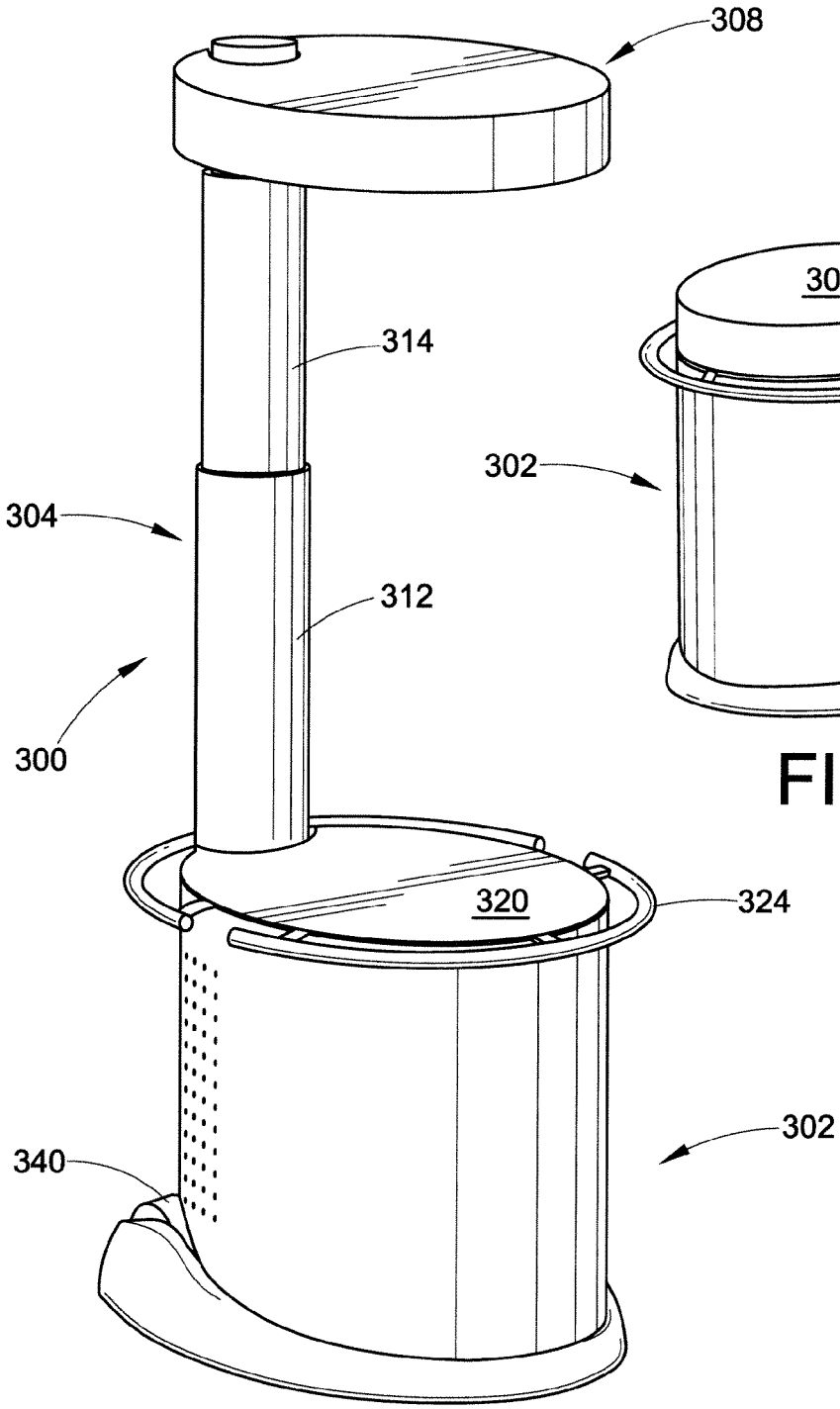
FIG. 15 is a front perspective view of a portable, collapsible radiant heater in an extended position according to a third embodiment of the present disclosure.
Figure 16:
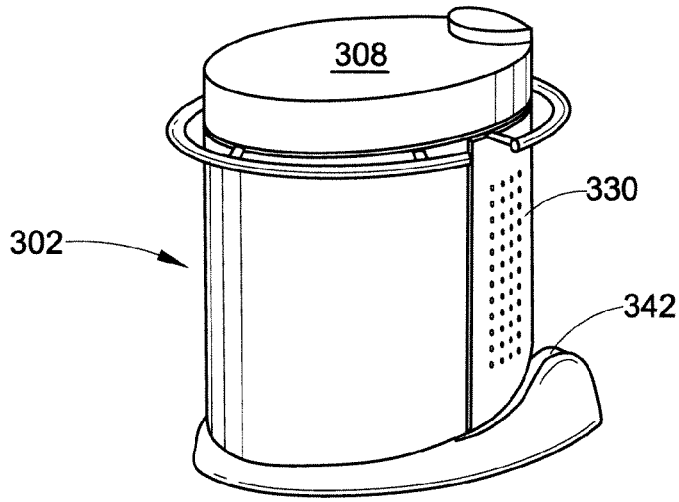
FIG. 16 is a front perspective view of the radiant heater of FIG. 15 in a collapsed position.

In the embodiment of FIGS. 15 and 16, a portable collapsible heater 300 includes a base 302, a collapsible support 304, a heater-head (not shown) and a reflector 308. Similar to the first embodiment, the collapsible support includes at least two interconnected sections 312, 314, section 314 being telescopically received within and secured to section 312. Similar to the previous embodiments, fasteners can be used to releasably lock the sections together. Alternatively, a single aperture can be formed along an exterior periphery of section 314 and is selectively and slidably aligned with one of a plurality of openings formed along an exterior periphery of section 312. An outwardly biasing spring-loaded clip portion (not shown) can be inserted within section 314 so that an outwardly biasing button portion (not shown) selectively projects through the single aperture and one of the plurality of openings of the overlapping section 312. The overall length of the collapsible support may be adjusted simply by pressing the button portion inwardly and then axially sliding the sections 312, 314 relative to one another until a desired opening of the plurality of openings aligns over the single aperture, at which point the button portion will again project downwardly through the aperture and one of the plurality of openings snapping the sections 312, 314 in place.

In the collapsed position, the heater-head is positioned adjacent a top surface 320 of the base and the reflector at least partially covers the top surface. The base can have an interior space (not shown) for containing a source of compressed or liquefied gas fuel therein. At least one rail 324 is attached to a top portion of the base. A door 330 is hingedly connected to the base to close the interior. A skirt 336 is attached to a lower portion of the base 302. A portion of the skirt is generally flush with the floor to eliminate tipping of the heater. A pair of wheels 340, 342 is operably connected to the base.

Figure 17:
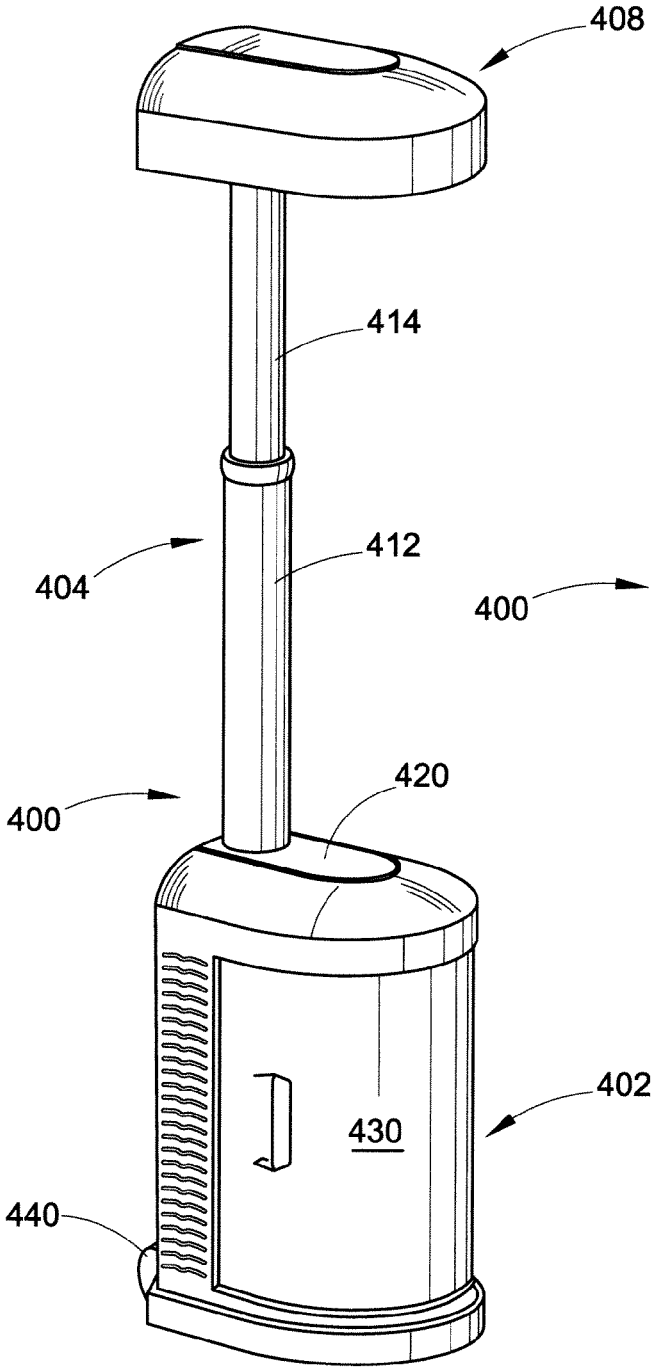
FIG. 17 is a front perspective view of a portable, collapsible radiant heater in an extended position according to a fourth embodiment of the present disclosure.
Figure 18:
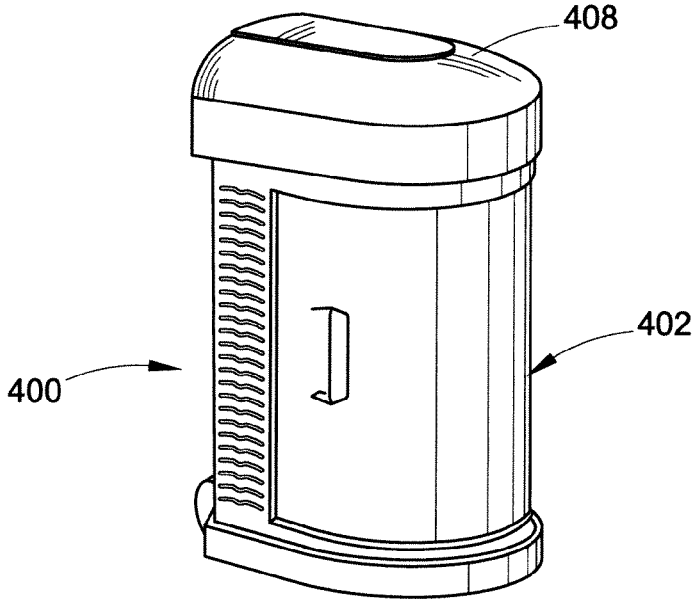
FIG. 18 is a front perspective view of the radiant heater of FIG. 17 in a collapsed position.

In the embodiment of FIGS. 17 and 18, a portable collapsible heater 400 includes a base 402, a collapsible support 404, a heater-head (not shown) and a reflector 408. Similar to the first embodiment, the collapsible support includes at least two interconnected sections 412, 414, which can be releasably secured to one another in a similar manner as described above. In the collapsed position, the sections are received in an opening 416 located on the base that leads to an interior space of the base, which can also contain a source of compressed or liquefied gas fuel therein. This allows the heater-head to be positioned adjacent a top surface 420 of the base and the reflector to at least partially covers the top surface. A door 430 is hingedly connected to the base to close the interior. A lower portion of the base is generally flush with the floor to eliminate tipping of the heater. A pair of wheels 440 (only one being shown) is operably connected to the base.

As to a further discussion of the structure of the embodiments of FIGS. 13-18, the same should be apparent from the description relative to the first embodiment. Accordingly, no further discussion will be provided.

Figure 19:
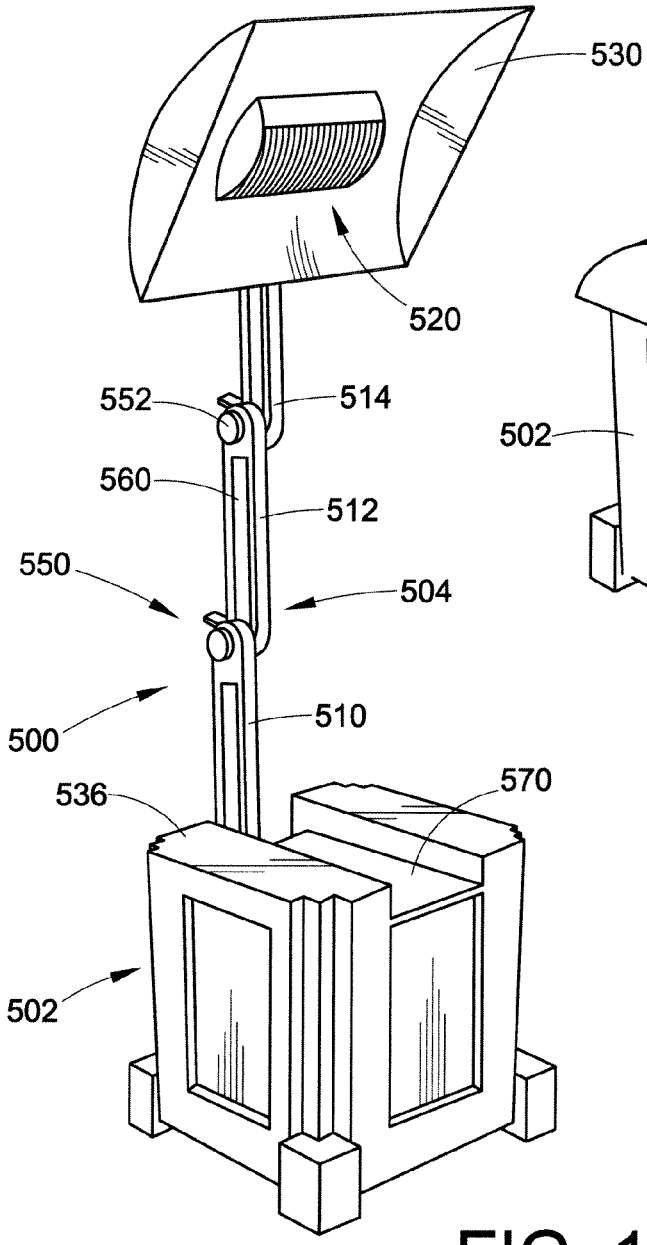
FIG. 19 is a front perspective view of a portable, collapsible radiant heater in an extended position according to a fifth embodiment of the present disclosure.
Figure 20:
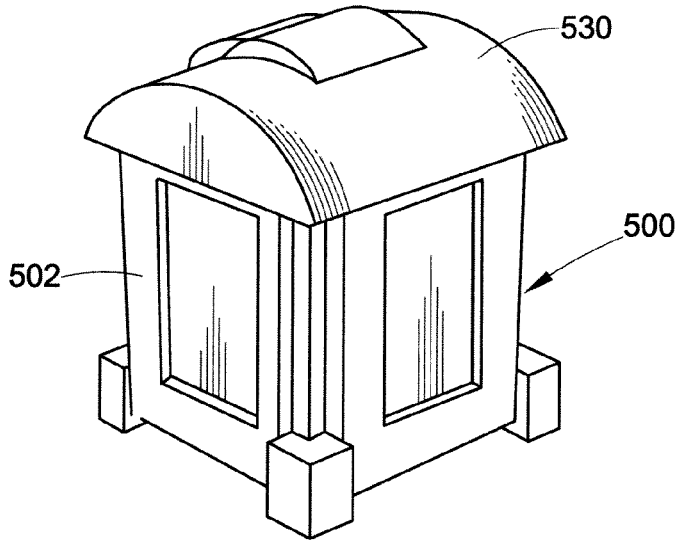
FIG. 20 is a front perspective view of the radiant heater of FIG. 19 in a collapsed position.

Another embodiment of a portable collapsible heater 500 is shown in FIGS. 19 and 20. In this embodiment, the heater includes a base 502 and a collapsible, accordion-like support 504 extending upwardly from the base. The support includes a plurality of interconnected sections 510, 512, 514 which allow a heater-head 520 and a reflector 530, which are pivotally secured to a top portion of the support, to sit on a top surface 536 of the base. Each section includes pivot joint or lock assembly 550 having a connector 552. The connector has one end positioned in an opening of one section and an opposite end extending through a slotted opening 560 of an adjacent section. In this regard, the height of the support can be adjusted by moving the connectors in the slotted openings. The lock assemblies also pivotally secure the sections to each other such that the sections can be folded downwardly. The top surface includes a channel 570 configured to receive the collapsed, folded sections of the support.

Still yet another embodiment of a portable heater 600 is shown in FIGS. 21-23. The heater includes a generally rectangular base 602 and at least one arm 604 extending from at least one side wall 610 of the base. It should be appreciated that other conformations for the base are also contemplated. For example, the base have a generally cylindrical shape. The at least one arm can include interconnecting sections (not shown) such that the at least one arm can collapse toward and/or into an interior space of the base.

The interior space of the base 602 can be dimensioned to contain a source of compressed or liquefied gas fuel therein. The at least one arm 604 preferably is hollow so that a gas line (not shown) can be run therethrough from the source of fuel to a heater-head or burner assembly 620 contained in a housing 622 therefor. A reflector (not shown) can be connected to the housing for directing or reflecting radiant heat. A control panel (not shown) for controlling the burner assembly can be provided on the at least one arm 604.

As shown in FIG. 21, the heater includes a pair of arms extending from opposite sides of the base. As shown in FIG. 22, the heater includes a pair of arms extending from adjacent sides of the base. As shown in FIG. 23, the heater can include interconnected arms extending from one side of the base. The fuel lines of the interconnected arms can be in communication with each other or separately connected to the source of fuel.

The present disclosure has been described with reference to several embodiments. Obviously, modifications and alterations will occur to others upon reading and understanding the preceding detailed description. It is intended that the present disclosure be construed as including all such modifications and alterations insofar as they come within the scope of the appended claims or the equivalents thereof.

What is claimed is:

1. A portable, collapsible radiant heater comprising:

a base;

a support mounted to the base, the support having a collapsed position wherein the base is configured to at least partially receive the support, and an extended position wherein the support extends upwardly from the base;

a heater-head for generating radiant heat connected to the support; and a reflector mounted to one of the heater-head and the support, the reflector at least partially surrounding the heater-head for downwardly reflecting radiant heat generated by the heater-head, wherein the reflector and heater-head are reciprocally movable between the collapsed position wherein the reflector and heater-head are in close proximity to the base and the extended position wherein the reflector and heater-head are distant from the base.

2. The radiant heater of claim 1, wherein the support includes a first section and a separate second section moveably connected to the first section.

3. The radiant heater of claim 2, wherein the second section is at least partially telescopically received in the first section.

4. The radiant heater of claim 2, wherein in the extended position, a longitudinal axis defined by the first section is collinear with a longitudinal axis defined by the second section.

5. The radiant heater of claim 2, wherein the first section is pivotally mounted to the base.

6. The radiant heater of claim 5, wherein the support has an accordion-like configuration and includes a pivot joint, the first section and the second section being interconnected by the pivot joint.

7. The radiant heater of claim 1, wherein the base includes an opening, the support being at least partially received in the opening in the collapsed position.

8. The radiant heater of claim 1, wherein the base includes a top surface, wherein in the collapsed position the reflector is configured to at least partially cover the top surface of the base.

9. The radiant heater of claim 1, wherein the heater-head is pivotally connected to the support.

10. The radiant heater of claim 1, wherein the heater-head is one of a gas heater-head and an electric heater-head.

11. A portable, collapsible radiant heater comprising:

a base including a top surface;

a collapsible support mounted to the base;

a burner assembly for igniting fuel from a fuel source housed in the base, the burner assembly being pivotally connected to the support; and a reflector mounted to one of the burner assembly and the support, the reflector at least partially surrounding the burner assembly for downwardly reflecting radiant heat generated by the burner assembly, wherein in a collapsed position, an outer periphery of the reflector at least partially covers the top surface of the base thereby providing for a compact, easily storable radiant heater.

12. The radiant heater of claim 11, wherein the support includes a first elongated member and a second elongated member, the second elongated member being at least partially telescopically received in the first elongated member.

13. The radiant heater of claim 12, wherein the support further includes a third elongated member, the third elongated member being at least partially telescopically received in the second elongated member.

14. The radiant heater of claim 12, further comprising a locking structure for selectively locking said second elongated member in a desired position in relation to said first elongated member.

15. The radiant heater of claim 11, wherein the base is configured to at least partially receive the support in a collapsed position.

16. A portable, collapsible radiant heater comprising:

a base including a top surface;

a telescopic support mounted to the base;

a heater-head for generating radiant heat connected to the support; and a reflector mounted to one of the heater-head and the support, the reflector at least partially surrounding the heater-head for downwardly reflecting the radiant heat, wherein the reflector and heater-head are telescopically movable between a collapsed position wherein the reflector and heater-head are in close proximity to the base and an extended position wherein the reflector and heater-head are distant from the base.

17. The radiant heater of claim 16, wherein in the collapsed position, an outer periphery of a lower portion of the reflector at least partially covers a top surface of the base thereby providing for a compact, easily storable radiant heater.

18. The radiant heater of claim 6, wherein the heater-head is pivotally connected to the support.

19. The radiant heater of claim 16, wherein the support includes a first elongated member and a second elongated member, the first elongated member including a hollow interior which accommodates at least a portion of said second elongated member.

20. The radiant heater of claim 16, wherein the base is configured to at least partially receive the support in the collapsed position.

* * * * *